United States Patent [19]

Gerber

[11] Patent Number: 4,494,433

[45] Date of Patent: Jan. 22, 1985

[54] APPARATUS FOR WORKING ON SHEET MATERIAL AND HAVING MOVABLE VACUUM CHAMBER

[75] Inventor: Heinz J. Gerber, West Hartford, Conn.

[73] Assignee: Gerber Garment Technology, Inc., South Windsor, Conn.

[21] Appl. No.: 342,507

[22] Filed: Jan. 25, 1982

[51] Int. Cl.[3] ..... B26D 5/00; B26D 7/00; B26D 1/00

[52] U.S. Cl. ..... 83/374; 83/373; 83/100; 83/925 CC

[58] Field of Search ..... 83/71, 100, 373, 374, 83/375, 925 CC

[56] References Cited

U.S. PATENT DOCUMENTS

| | | | |
|---|---|---|---|
| 3,495,492 | 2/1970 | Gerber et al. | 83/374 |
| 3,848,327 | 11/1974 | Gerber et al. | 83/374 |
| 4,114,490 | 9/1978 | Braun et al. | 83/100 |
| 4,124,919 | 11/1978 | Klyce | 83/100 |
| 4,200,417 | 4/1980 | Hager et al. | 83/100 |
| 4,241,505 | 12/1980 | Bodycomb et al. | 83/100 |
| 4,242,934 | 1/1981 | Coburn | 83/100 |
| 4,255,995 | 3/1981 | Connor | 83/100 |
| 4,308,774 | 1/1982 | Bohler et al. | 83/100 |
| 4,315,794 | 2/1982 | Palmieri | 83/100 |

*Primary Examiner*—Paul A. Bell
*Assistant Examiner*—Paul M. Heyrana
*Attorney, Agent, or Firm*—McCormick, Paulding & Huber

[57] ABSTRACT

An apparatus for cutting sheet material as a cantilever vacuum table with a fluid permeable support surface upon which sheet material may be spread. A movable vacuum box supported below the surface of the table defines a vacuum chamber and is connected outboard of a free edge of the table to a carriage assembly which moves a blade in cutting relation to material spread on the table in response to signals received from a programmable controller. The vacuum box moves with the blade and relative to the table to apply vacuum to a limited area of the table immediately surrounding the cutting region of the blade.

9 Claims, 6 Drawing Figures

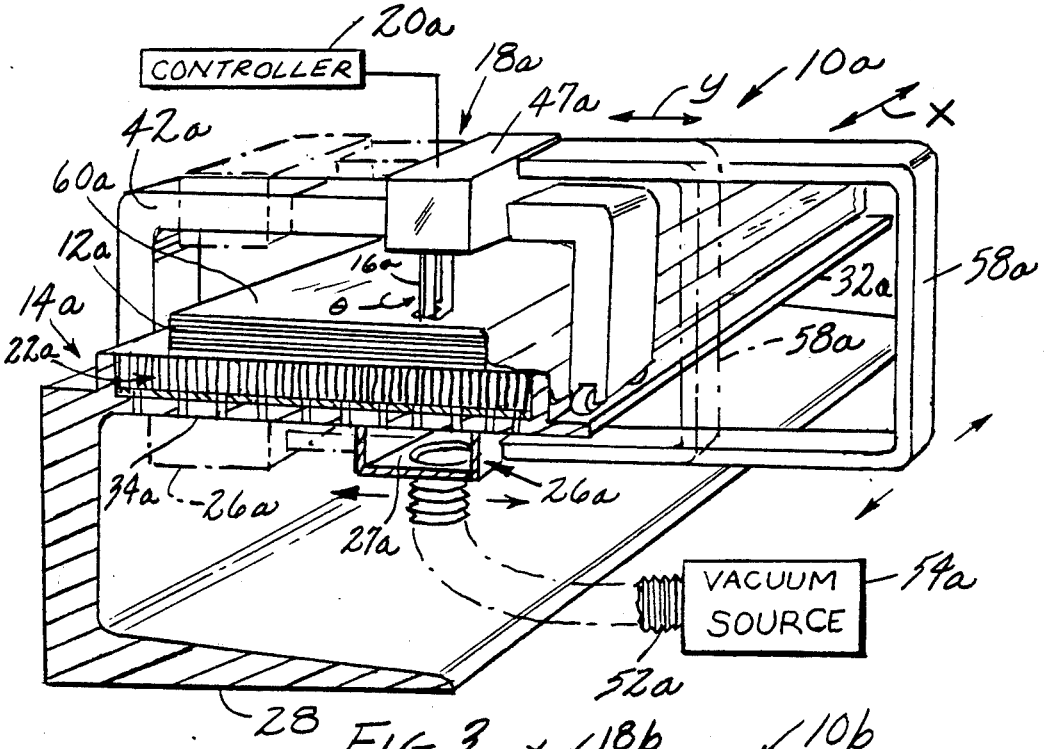
FIG 3
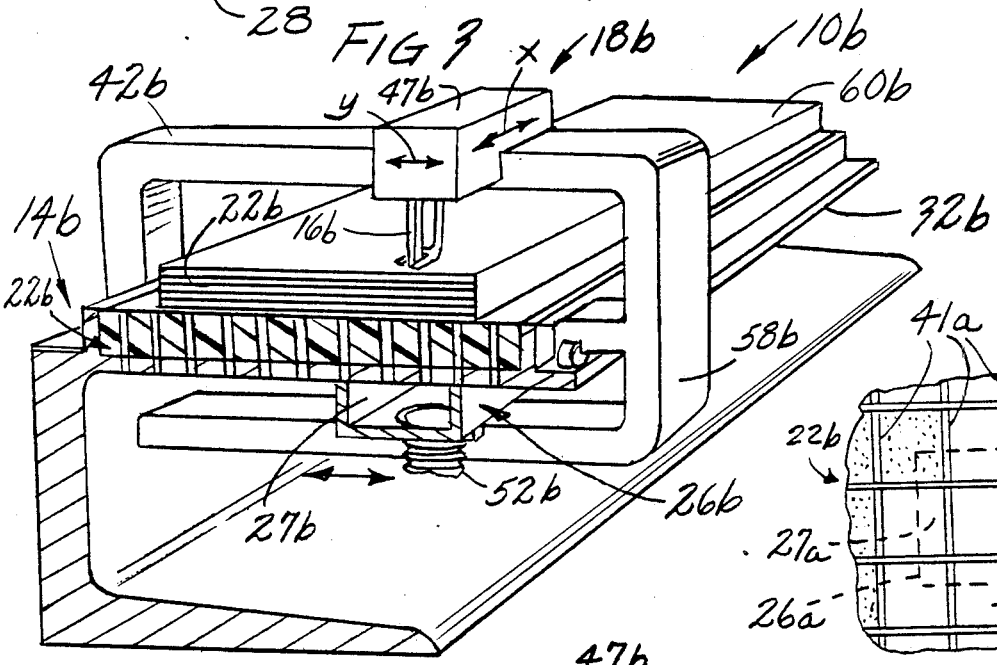
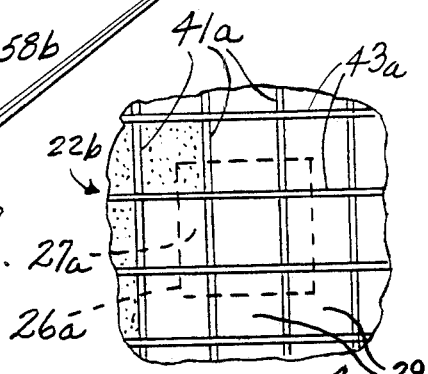
FIG 4
FIG 5
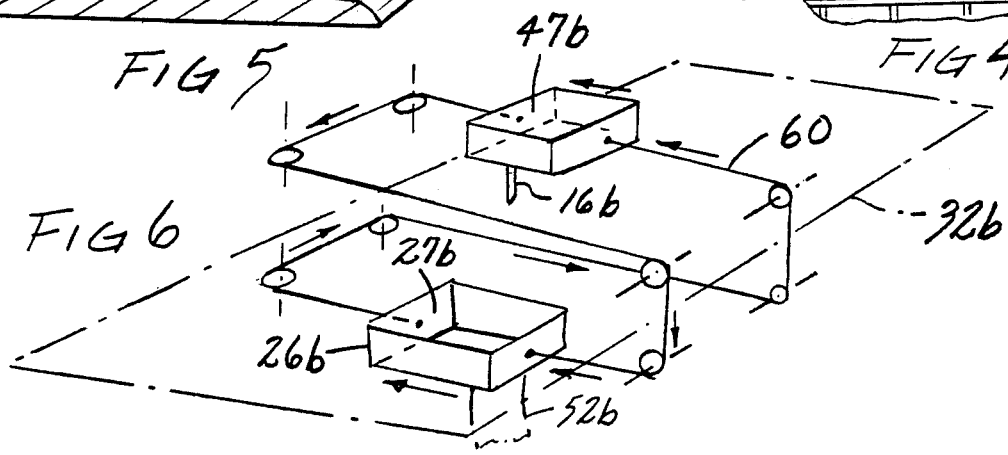
FIG 6

APPARATUS FOR WORKING ON SHEET MATERIAL AND HAVING MOVABLE VACUUM CHAMBER

BACKGROUND OF THE INVENTION

This invention relates in general to apparatus for working on sheet material and which includes a vacuum holddown table for securing a portion of a sheet of material in firmly fixed position on the table surface in the working region of a tool which moves relative to the table surface and in working relation to the sheet material spread on the table surface.

Vacuum holddown tables have gained widespread acceptance in the sheet material processing art, however, the equipment used to generate vacuum is usually relatively large, consumes considerable energy and tends to be quite inefficient. In order to increase efficiency of such apparatus, "zoned" vacuum tables have been provided which permit migration of a vacuum zone relative to a supporting surface of a holddown table so that vacuum may be concentrated or applied locally to a portion of the supporting surface in the working region of a movable instrument or tool. On such sheet material processing apparatus, illustrated and described in U.S. Pat. No. 3,495,492 to Gerber et al, issued Feb. 17, 1970, and assigned to the assignee of the present invention, has a vacuum holddown table which utilizes a series of stationary vacuum chambers disposed below a fluid permeable bed which defines the sheet material supporting surface. Valves associated with the chambers operate in response to controlled movement of a tool longitudinally of the table to sequentially connect and disconnect the various chambers to a common vacuum manifold whereby vacuum may be applied to successive zones of the supporting surface. Other apparatus has been provided which includes a vacuum table, a portion of the surface of which is defined by one or more movable belts. Vacuum is applied to an associated portion of the table surface through a gap in the belts. While such apparatus has proven generally satisfactory it includes considerable mechanism and is relatively costly to produce. Further, such apparatus generally applies vacuum to a strip or zone of the table surface which extends transversely across the entire width of the surface. Thus, vacuum is applied to a somewhat greater area of the table surface then may be necessary to effect efficient holddown of the material in the working region of a tool, which results in inefficient utilization of vacuum generating equipment. The present invention is concerned with the aforesaid problems.

SUMMARY OF THE INVENTION

An apparatus for working on sheet material has a vacuum table which defines a fixed fluid permeable support surface upon which sheet material may be spread and means for producing a vacuum at a portion of the support surface to hold sheet material spread over the latter portion of the surface in firmly fixed engagement with said portion of the surface. The apparatus further includes an instrument or tool and means for moving the instrument relative to the support surface and in working relation to sheet material spread thereon. In accordance with the invention the vacuum producing means comprises a movable vacuum chamber located below the support surface and means for moving the vacuum chamber in response to movement of the instrument by the instrument moving means. A means is also provided for maintaining the vacuum chamber in general vertical registry with the moving instrument, whereby the portion of the support surface at which vacuum is applied is maintained generally within the working region of the instrument.

BRIEF DESCRIPTION OF THE DRAWINGS

FIG. 3 is a somewhat schematic perspective view of another embodiment of the invention shown partially in transverse section.

FIG. 4 is a fragmentary plan view of the table shown in FIG. 3.

FIG. 5 is similar to FIG. 3 but shows still another embodiment of the invention.

FIG. 6 is a somewhat schematic perspective view of a portion of the apparatus shown in FIG. 4.

DETAILED DESCRIPTION OF PREFERRED EMBODIMENTS

Figure 1:
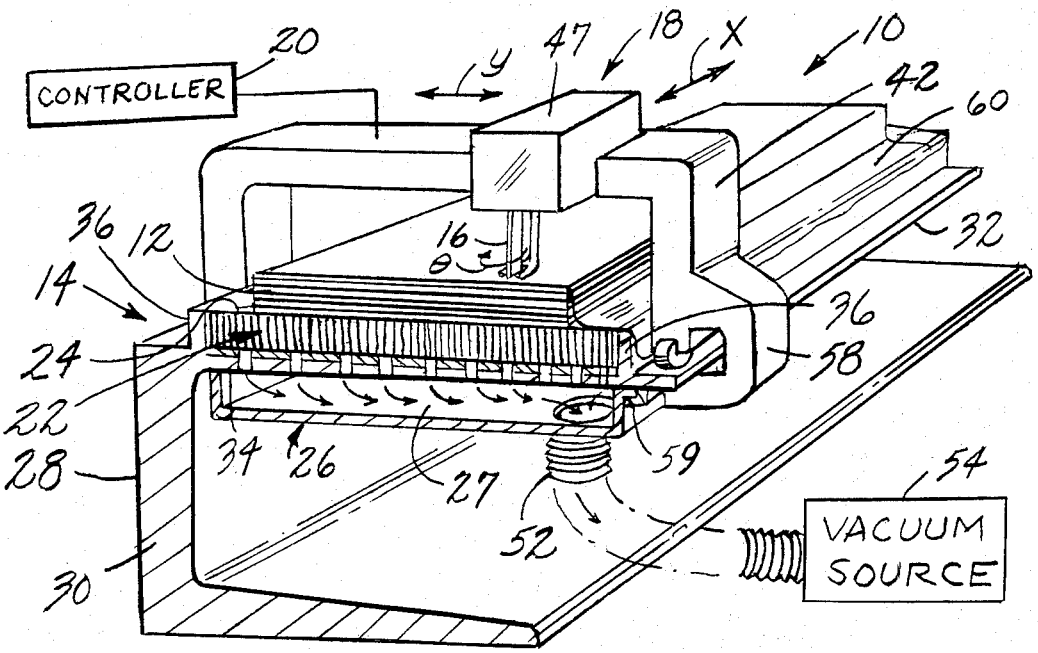
FIG. 1 is a somewhat schematic perspective view of an apparatus for working on sheet material and embodying the present invention shown partially in transverse section.
Figure 2:
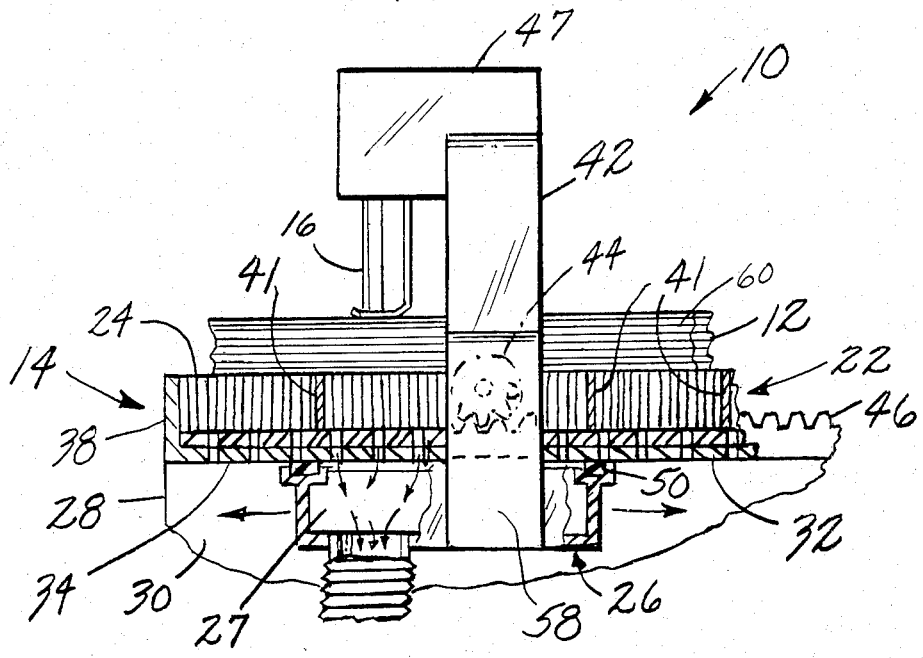
FIG. 2 is a fragmentary side elevational view of the apparatus of FIG. 1 shown partially in longitudinal section.

Turning now to the drawings, and referring first particularly to FIGS. 1 and 2, an apparatus for working on sheet material and embodying the present invention is shown somewhat schematically and indicated generally by the reference numeral 10. The apparatus 10 is particularly adapted for cutting pattern pieces from a layup of sheet material, designated by the numeral 12, and includes a vacuum table assembly, indicated generally at 14, an instrument or cutting tool 16 and a carriage assembly, designated generally by the numeral 18, for moving the cutting tool relative to the table assembly 14 and in cutting engagement with the layup 12 in response to signals received from a programable controller 20.

The table assembly 14 includes a fluid permeable bed, indicated generally at 22, which defines a sheet material supporting surface 24. The table assembly further includes a movable vacuum box indicated generally at 26, supported below the bed 22, and which partially defines a vacuum chamber 27 for producing vacuum at a limited area of the support surface 24 in the region of the cutting tool 16 to hold a portion of the layup 12 in firmly fixed engagement with an associated portion of the supporting surface 24 as the cutting tool 16 moves in cutting engagement with the layup. A means is provided for moving the vacuum box 26 relative to the bed 22 in response to movement of the cutting tool 16 relative to the supporting surface 24. A means is also provided for maintaining the vacuum chamber 27 in generally vertical registry with the movable cutting tool 16, so that the applied vacuum is concentrated in the working region of the tool to assure production of accurately cut pattern pieces in response to a predetermined controller program.

Considering now the apparatus 10 in further detail, the table assembly 14 includes a table 28 which has a base 30. A table top, indicated at 32, is supported in cantilever position by an upright portion of the base 30 and includes a perforated bottom wall 34, a pair of opposing side walls 36, 36 and a pair of opposing end walls 38, 38, one shown in FIG. 2. The side and end walls cooperate with the bottom wall 34 to define an upwardly open recess for containing the fluid permeable bed 22 which defines the support surface 24.

The bed may take various forms, however, the illustrated bed 22 comprises a bristle bed of a well known type which has a perforated base supporting a multiplicity of upwardly projecting bristles, the upper ends of which collectively define the support surface 24. The bed 22 may comprise a continuous bristle mat or, if desired, may be formed by a plurality of individual, replacable bristle blocks arranged in adjacent relation to each other within the recess 40, in a manner well known in the art. It should be noted that each perforation in the base of the bristle bed 22 is respectively vertically aligned with an associated perforation in the bottom wall 34. Preferably, and as shown in FIG. 2, a longitudinal series of disposable partitions 41, 41 are positioned within the bed 22 between the bristles thereof and extend transversely of the bed between the side walls 36, 36. The partitions divide the bed into a plurality of narrow transversely extending cells separated from each other and serve to restrict horizontal air flow through the bed. The partitions are made from material which may be readily cut by the cutting tool 16 without damaging the cutting tool.

The carriage assembly 18 has an X carriage 42 which bridges the table top 32 and which is supported by the table 28 on ways which extend longitudinally of the table at opposite sides thereof. Driven pinions 44, 44 (one shown in FIG. 2) mounted at opposite sides of the X carriage 42 engage stationary racks 46, 46 at opposite sides of the table 28 to move the carriage assembly 18 longitudinally of the table or in an X-coordinate direction in response to command signals received from the controller 20 by a pinion drive motor (not shown). A Y carriage 47 mounted on the bridging portion of the X carriage 42 is supported to move transversely of the X carriage and the table 28 or in the Y-coordinate direction. The Y carriage 47 is or may be driven by a lead screw and an associated drive motor (not shown) in response to signals from the controller 20.

The illustrated tool 16 comprises a vertically reciprocally movable blade mounted on the Y carriage 47 to move with it. The blade 16 may be further arranged for angular movement about its vertical axis in a $\theta$ coordinate direction in response to motor control signals from the controller, in a manner well known in the sheet material cutting art.

The movable vacuum chamber 27 is partially defined by the generally rectangular upwardly open vacuum box 26 which is disposed below the table top 32 in engagement with the lower surface of the bottom wall 34. The upper edges of the vacuum box 26 have an upwardly opening channel formed therein which contains an annular wiper seal 50 disposed in sealing engagement with the lower surface of the bottom wall 34. The illustrated vacuum box 26 has a transverse width substantially equal to the width of the bed 22 and is connected by a flexible duct 52 to a vacuum generator or vacuum source illustrated schematically in FIG. 1 and designated by the numeral 54. The vacuum box is supported for longitudinal movement with the blade 16 relative to the support surface 24 and is maintained in generally vertical registry with the blade by a rigid connecting member 58 which connects the vacuum box 26 to the carriage assembly 18 outboard of the free edge of the table top 32, as best shown in FIG. 1. The vacuum box 26 is or may be further supported by a pair of longitudinally extending and inwardly opening channels, such as the channel 59 shown in FIG. 1. The channels 59, 59 receive longitudinally disposed and transversely outwardly extending flanges on the vacuum box 48 which slide within the channels.

The illustrated layup 12 comprises a plurality of sheets of porous fabric arranged in vertically stacked relation to each other. A disposable sheet of air impervious plastic material, indicated by the numeral 60, overlays the layup, in a manner well known in the art.

As the blade 16 moves longitudinally of the table 28 with the carriage assembly 18 and in response to command signals from the controller 20 the vacuum box 26 also moves longitudinally of the table with the carriage assembly 18 to produce a narrow moving vacuum zone at the surface 24 which extends transversely across the surface in the region of the blade 16. Thus, vacuum is applied to the table only in the region where the blade 16 is operating. The partitions 41, 41 are preferably longitudinally spaced so that the vacuum chamber 27 communicates with not more than two adjacent cells within the bristle bed 22 at any time during its travel relative to the table 28. The disposable partitions 41, 41 may be removed when damaged by the blade and replaced, as necessary.

In the aforedescribed apparatus 10, the vacuum chamber extends across substantially the entire width of the table top 32 and provides a narrow transversely elongate vacuum zone which moves longitudinally of the support surface 24 or in the X-coordinate direction in response to movement of the blade 16 relative to the support surface. However, additional advantage in the form of reduced vacuum generating requirements may be realized by further reducing the size of the movable vacuum chamber and arranging it for movement in two coordinate directions relative to the sheet material support surface 24 and in tracking relation to the blade 16. Such apparatus is illustrated in FIG. 3 and indicated generally by the reference numeral **10*a*. Parts of the apparatus 10*a* which are similar or substantially identical to parts of the apparatus 10**, previously described, bear the same reference numerals as the previously described parts and a letter "a" suffix and will not be hereinafter further described.

Like the apparatus 10, the apparatus **10*a* includes a table assembly 14*a* and a movable carriage assembly 18*a* which moves a cutting tool 16*a* relative to a table support surface 24*a* in response to command signals received from a controller 20*a*. However, the apparatus 10*a* differs from the apparatus 10 in the construction of its vacuum box 26*a* and the manner in which the vacuum box is supported for movement relative to the material support surface 24*a* and maintained in general vertical registry with the tool 16*a***.

Specifically, the vacuum box **26*a* is considerably smaller than the vacuum box 26 in that it does not extend across substantially the entire width of the bed surface 24*a*, as in the previously described construction. Further, the vacuum box 26*a* is connected to the Y carriage outboard of the free edge of the table 32*a* by a rigid generally C-shaped connecting member 58*a* which maintains the vacuum box 26*a* in sealing engagement with the lower surface of the bottom wall 34*a*. The vacuum box 26*a* is supported for movement longitudinally or in the X-coordinate direction relative to the table 28*a* in response to movement of the X carriage 42*a* relative to the table. The vacuum box is further supported by the connecting member 58*a* for movement transversely of the table 28a or in the Y direction in response to movement of the Y carriage on the X carriage and relative to the support surface 24a. The support member 58a maintains the vacuum chamber 27a in general vertical registry with the cutting tool 16a so that vacuum is applied to a relatively small area of the support surface 24a immediately surrounding the working region of the movable tool 16a**.

Preferably, and as shown in FIG. 4, a series of transversely extending disposable partitions 41a, 41a which extend between the side walls 36a, 36a and another series of longitudinally extending disposable partitions 43a, 43a which extend between the end walls 38a, 38a and intersect the partitions 41a, 41a are disposed within the bristle bed 22a as shown in FIG. 4. The partitions divide the bed 22a into a multiplicity of cells 39, 39 which are isolated from each other whereby to restrict horizontal air flow through the bed in both longitudinal and transverse directions and concentrate the vacuum holddown force in the immediate area surrounding the tool. In FIG. 4 the vacuum chamber 27a is positioned so that it may communicate with nine contiguous cells 39, 39 to apply vacuum to an area of the surface 24a defined by the nine cells.

The rigid connecting member 58a which extends between the Y carriage 47a and the vacuum chamber box 26a, as illustrated in FIG. 3, provides a simple and relatively inexpensive means for moving the vacuum box in at least two coordinate directions while retaining it in vertical registry with the cutting tool 16a, however, such apparatus requires considerable floor space to accommodate transverse movement of the connecting member 58a.

In FIGS. 5 and 6 there is shown another apparatus 10b embodying the invention and which is particularly suitable for use where floor space is limited. The apparatus 10b is similar in some respects to the apparatus 10, previously described, however, it utilizes a destructable fluid permeable bed 22b which is preferably made from an expanded rigid polystyrene plastic such as STYROFOAM. The bed is preferably formed from a plurality of individual plastic blocks arranged in adjacent side-by-side relation and has a multiplicity of vertical passageways which extend through it, each passageway being in registry with an associated opening in the bottom wall 34b, substantially as shown in FIG. 5.

Like the apparatus 10a, previously described, the apparatus 10b has a relatively small vacuum chamber partially defined by a vacuum box 26b which is supported for movement both longitudinally and transversely of the table top 32b. A rigid support member 58b mounted in fixed position on the carriage assembly 18b has a horizontally disposed leg which extends transversely of the table below the vacuum box 48b. The vacuum box is guided for transverse sliding movement on the latter leg of the support member 58b and relative to the sheet material support surface 24b defined by the bed 22b and is longitudinally movable with the carriage assembly 18b and relative to the table 28b in response to signals from a programmable controller (not shown). Transverse movement is imparted to the vacuum box 26b by the Y carriage 46b through a flexible connection or cable assembly 60, shown somewhat schematically in FIG. 6, which includes a flexible cable supported by a plurality of pulleys mounted on the X carriage 42b. The cable assembly 60 which comprises part of the connecting means also functions to maintain the vacuum box 26b in generally vertical registry with the cutting tool 16b.

Since air is constrained to flow through the bed 22b in only the vertical direction partitions or separators are not required within the bed structure. Repeated penetration of the bed by the cutting blade 16b will, of course, eventually damage it to the extent that all or part of the bed may require replacement. It is for this reason that the bed 22b is preferably made from a plurality of individual plastic blocks arranged in adjacent side-by-side relation. Thus, when bed damage occurs only those blocks which are severly damaged need by replaced.

I claim:

1. In an apparatus for working on sheet material and having a table defining a fixed fluid permeable support surface upon which sheet material may be spread, and instrument, means supported by the table for moving the instrument longitudinally and transversely of the support surface in working relation to sheet assembly and having a first carriage supported for movement longitudinally of said support surface and a second carriage supported on said first carriage for movement with said first carriage and transversely of said first carriage and said support surface, and means for producing vacuum at a portion of said support surface in the working region of the instrument to hold sheet material spead over the portion of the support surface in firmly fixed engagement with the portion of the support surface, the improvement wherein said vacuum producing means comprises means defining a movable vacuum chamber located below said support surface, means connecting said vacuum producing means to one of the carriages comprising said first and second carriages for moving the vacuum chamber defining means in response to movement of said instrument by said instrument moving means, said connecting means connecting said vacuum producing means to said one carriage outboard of a free edge of said table, and means for maintaining said vacuum defining means below said instrument with said vacuum chamber in general vertical registry with the moving instrument.

2. In an apparatus for working on sheet material as set forth in claim 1 the further improvement wherein said connecting means comprises a rigid connecting member.

3. In an apparatus for working on sheet material as set forth in claim 1 the further improvement wherein said one carriage comprises said first carriage.

4. In an apparatus for working on sheet material as set forth in claim 1 the further improvement wherein said table is supported in cantilever position.

5. In an apparatus for working on sheet material and having a vacuum table assembly including a fluid permeable bottom wall and defining a fixed fluid permeable upper support surface upon which sheet material may be spread, a carriage assembly including a first carriage supported for movement longitudinally of the support surface and a second carriage supported on the first carriage for movement with the first carriage and transversely of said first carriage and said support surface, an instrument supported on the second carriage, a programmable controller, means for moving said carriage assembly in response to signals received from the programmable controller to move the instrument in working relation to sheet material spread on the support surface, and means for producing vacuum at a portion of the support surface in the working region of the instrument to hold sheet material spread over the portion of the support surface in firmly fixed engagement with the portion of the support surface, the improvement comprising said vacuum producing means including an upwardly open vacuum box disposed in generally sealing engagement with the lower surface of said bottom wall and having a transverse dimension substantially equal to the transverse dimension fo said support surface, said vacuum box cooperating with an associated portion of said bottom wall to define a movable vacuum chamber generally below the transverse path of said instrument and in communicating with said fluid permeable support surface, and said apparatus including a rigid connecting member connected in fixed position to said first carriage and to said vacuum box, said connecting member connecting said vacuum box to said first carriage outboard of a longitudinally extending free edge of said table assembly to move longitudinally of said table assembly with said first carriage.

6. In an apparatus for working on sheet material and having a vacuum table assembly including a fluid permeable bottom wall and defining a fixed fluid permeable upper support surface upon which sheet material may be spread, a carriage assembly including a first carriage supported for movement longitudinally of the support surface and a second carriage supported on the first carriage for movement with the first carriage and transversely of said first carriage and said support surface, an instrument supported on the second carriage, a programmable controller, means for moving said carriage assembly in response to signals received from the programmable controller to move the instrument in working relation to sheet material spread on the support surface, and means for producing vacuum at a portion of the support surface in the working region of the instrument to hold sheet material spread over the portion of the support surface in firmly fixed engagement with the portion of the support surface, the improvement wherein said vacuum producing means comprises an upwardly open vacuum box disposed in generally sealing engagement with the lower surface of said bottom wall and cooperating with an associated portion of said bottom wall to define a movable vacuum chamber generally below said instrument and in communicating with said fluid permeable support surface and said apparatus includes a connecting member connected to said first carriage and supporting said vacuum box for movement longitudinally of said table assembly with said first carriage and for movement transversely of said table assembly and means for moving said vacuum box transversely of said table assembly with said second carriage assembly and maintaining said vacuum chamber in general vertical registry with said moving instrument.

7. In an apparatus for working on sheet material as set forth in claim 6 the further improvement wherein said means for moving said vacuum box transversely of said table assembly comprises flexible connecting means for connecting said vacuum box to said second carriage.

8. In an apparatus for working on sheet material as set forth in claim 7 the further improvement wherein said flexible connecting means comprises a cable.

9. In an apparatus for working on sheet material and having means defining a fixed fluid permeable support surface upon which sheet material may be spread, an instrument, means for moving the instrument longitudinally and transversely of the support surface in working relation to sheet material spread on the support surface including a carriage assembly having a first carriage supported for movement longitudinally of said support surface and a second carriage supported on said first carriage for movement with said first carriage and transversely of said first carriage and said support surface, and means for producing vacuum at a portion of said support surface in the working region of the instrument to hold sheet material spread over the portion of the support surface in firmly fixed engagement with the portion of the support surface, the improvement wherein said vacuum producing means comprises means defining a movable vacuum chamber located below said support surface, means connecting said vacuum chamber defining means to said second carriage to move in response to movement of said instrument by said instrument moving means, and means for maintaining said vacuum chamber defining means below said instrument with said vacuum chamber in general vertical registry with the moving instrument.

* * * * *